United States Patent [19]

Hopkins

[11] 3,966,082

[45] June 29, 1976

[54] ANNULAR COLLAR SAFETY CLOSURE

[75] Inventor: Brian D. Hopkins, Evansville, Ind.

[73] Assignee: Mead Johnson & Company, Evansville, Ind.

[22] Filed: Feb. 24, 1975

[21] Appl. No.: 552,073

[52] U.S. Cl. ..... 220/306; 220/354; 215/225; 215/274; 220/319

[51] Int. Cl.[2] ..... B65D 55/02

[58] Field of Search ..... 220/307, 353, 306, 299, 220/309, 354, 319; 215/206, 225, 274, 9

[56] References Cited

UNITED STATES PATENTS

| | | | |
|---|---|---|---|
| 3,669,295 | 6/1972 | Horvath | 215/206 |
| 3,693,820 | 9/1972 | Linkletter | 215/274 |
| 3,757,979 | 9/1973 | Berghahn | 215/225 |
| 3,773,204 | 11/1973 | Stroud | 215/9 |
| 3,811,589 | 5/1974 | Thornton et al. | 215/9 |

*Primary Examiner*—William Price
*Assistant Examiner*—Joseph M. Moy
*Attorney, Agent, or Firm*—Robert H. Uloth; Robert E. Carnahan

[57] ABSTRACT

A rotatable annular collar adapted for use with a conventional overcap of the snap-fit type and a container having a cylindrical mouth, an inwardly directed annular groove extending completely around the wall of the container and an outwardly projecting annular bead positioned at or between the mouth of the container and the annular groove formed for releasable holding engagement with the snap-fit cap is provided. The snap-fit cap has a top panel, an annular skirt depending therefrom and a lift tab extending outwardly from the lower margin of the depending skirt which also has an inwardly projecting annular bead adapted to snap over the outwardly projecting annular bead of the container. The rotatable annular collar has an upstanding exterior wall member with an access gate therein, an inwardly extending flange connecting the exterior wall member and an interior annular rib member frictionally fitted to the annular groove of the container. Extending outwardly from the inner wall of the flange is a raised flat area which circumferentially extends at least the width of the gate whereby access to the bottom rim of the depending skirt is prevented and the flange is reinforced. In order to remove the snap-fit cover from the container, the annular collar is rotated by grasping the annular upstanding wall member and turning until the access gate is aligned with the lift tab. By insertion of a finger or thumb nail between the raised flat area and the bottom of the lift tab the snap-fit cover is forced upward and removed.

1 Claim, 7 Drawing Figures

ANNULAR COLLAR SAFETY CLOSURE

BACKGROUND OF THE INVENTION

This invention relates generally to a safety closure container combination wherein the container has a conventional overcap of the snap-fit type. More particularly, the invention is concerned with an annular collar means for preventing removal of a non-rotatable overcap from a container by a child but whose removal does not present too great a problem for an adult.

The storage of medicines, household cleaning agents and other substances, which may be toxic or poisonous if used indescriminately, in order to prevent access thereto by children has received considerable attention. This has resulted in the availability of a variety of safety closure assemblies for medicine, vials and the like. A prior art child resistant container assembly such as that disclosed in U.S. Pat. No. 3,811,589 is illustrative of the type wherein a latching means and overcap rotate freely relative to the container and removal of the cap can take place only when the cap is pressed tightly against the rim of the container and held there while a latch ring is turned relative to both container and cap. Safety closures of this type do not maintain the overcap in sealing engagement with the upper end of the container as is generally desirable to protect the contents of the container from contamination or entry of moisture into the container or escape of volatile components from the container. U.S. Pat. No. 3,450,290 provides a safety closure for a container with an enlarged lip wherein a means for constricting an overcap preventing removal thereof over the enlarged lip of the container is provided. The constricting means is rotatable with respect to the cap and the container and after aligning keys extending from the overcap with key way slots in the latching means, the latching means must be moved axially in order to release the overcap from constriction and permit removal. In U.S. Pat. No. 3,584,760, a safety cap assembly for containers is provided wherein the overcap has a thumb piece lift and is connected to the container by a tie element. Access to the thumb piece lift is prevented by an annular rim blocking means biased by a spring means so that an access notch in the rim means is normally not in alignment with the thumb piece lift.

SUMMARY OF THE INVENTION

A principal object of the present invention is to provide a safety closure container combination which can be readily opened by an adult but is child resistant.

Another object of the present invention is to provide a safety closure container combination adapted for use with a conventional overcap of the snap-fit type having a top portion, a depending skirt and a lift tab extending from the lower margin of the skirt.

It is another object of this invention to provide a safety closure container combination using a snap-fit overcap and a rotatable closure means therefor which permits opening of the container only after first rotating the closure means relative to the container to permit insertion of a finger or thumb nail under the snap-fit cover lift tab in order to remove the cap.

In accordance with the present invention, the foregoing objects are achieved by a rotatable annular collar having an access gate cooperating with a container and snap-fit overcap which permits removal of the snap-fit cap only after rotating the annular collar to allow insertion of a finger or thumb nail through the access gate under the lift tab permitting an upwards force to be applied to the snap-fit cap. The annular collar is constructed of a resilient plastic material which conforms to the circumference of the container and has an upstanding exterior wall member and an interior annular rib member fitted to an inwardly directed annular groove in the container by a container engaging inner wall. The upstanding exterior wall member and the interior annular rib member are connected by a flange having a raised flat area extending outwardly from the inner wall member to prevent access to the lower peripheral edge of the depending skirt.

The preferred embodiment of the invention is illustrated by way of exemplification in the accompanying drawings in which.

For purposes of this patent application it will be understood that the can or like containers stand upright with the snap-fit cover in place and the annular safety collar thereover. Accordingly, positioning of parts will be described with relation to the axis of the container. Thus the term "axially" will mean either upwardly of downwardly while the term "radially" will mean either inwardly towards the axis or outwardly away from the axis of the container in its upright position.

Figure 1:
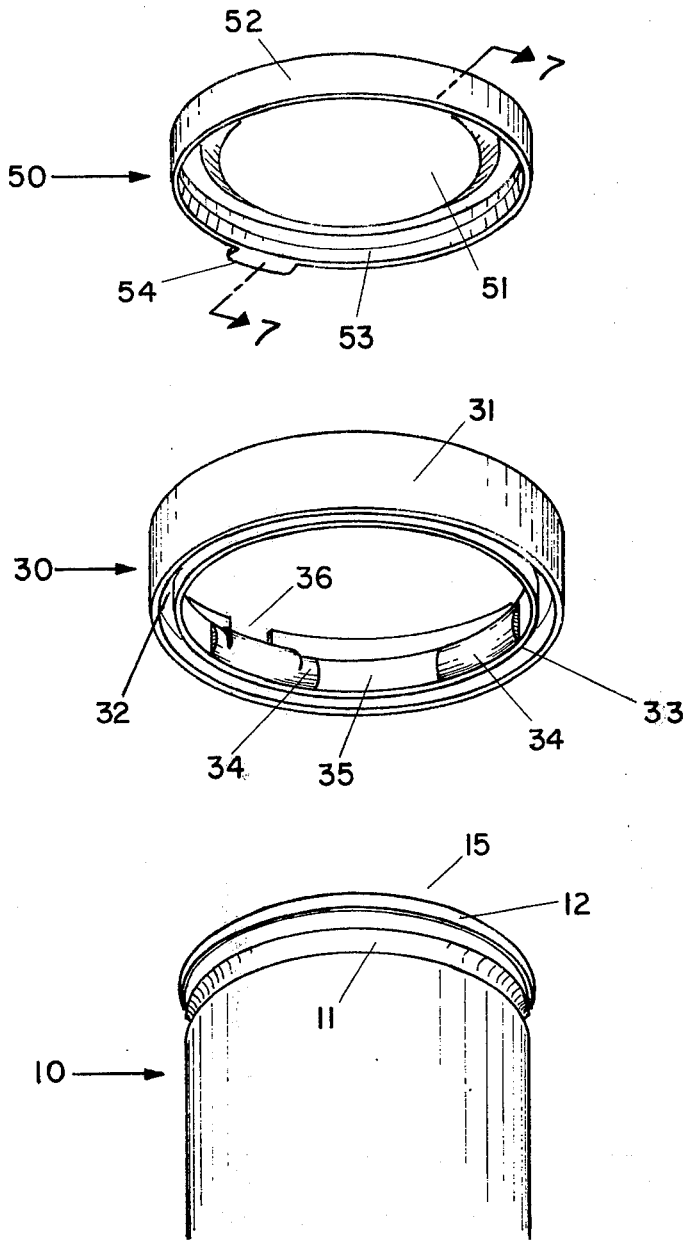
FIG. 1 is an exploded perspective view of the annular collar in combination with the snap-fit cover cap and the upper portion of the can or container to which it is to be applied.
Figure 2:
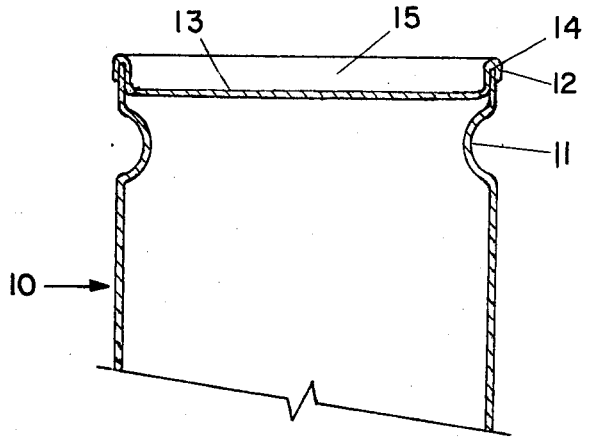
FIG. 2 is a vertical cross-section through the can or container of FIG. 1 fitted with an easy opening end means.
Figure 3:
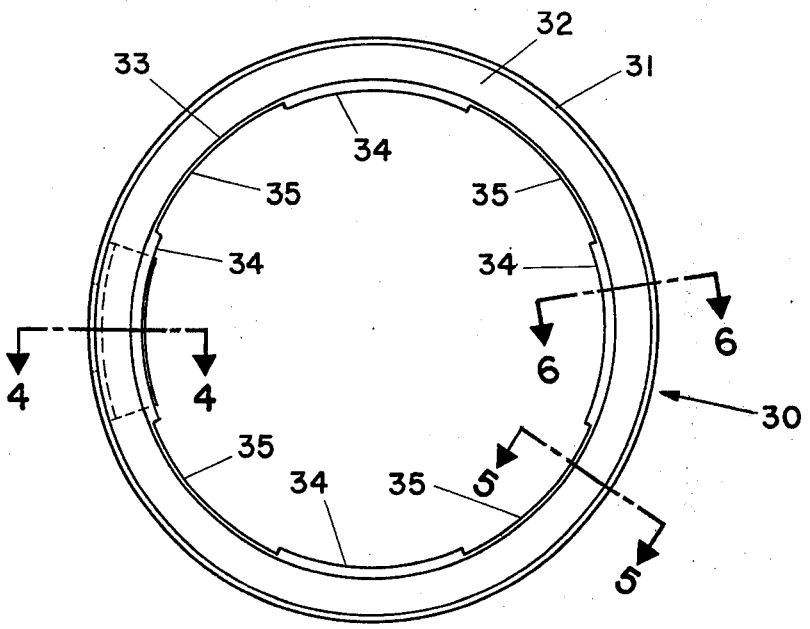
FIG. 3 is a bottom plan view of the annular collar.
Figure 4:
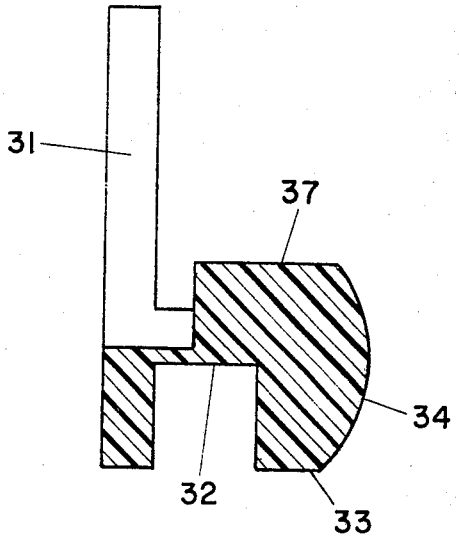
FIG. 4 is an enlarged fragmentary vertical sectional view taken through line 4—4 of FIG. 3.
Figure 5:
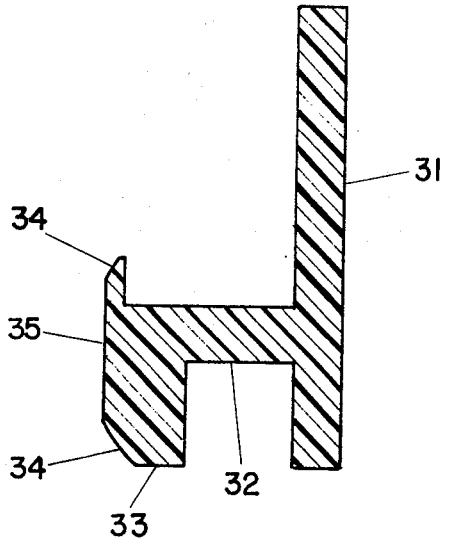
FIG. 5 is an enlarged fragmentary vertical sectional view taken through line 5—5 of FIG. 3.
Figure 6:
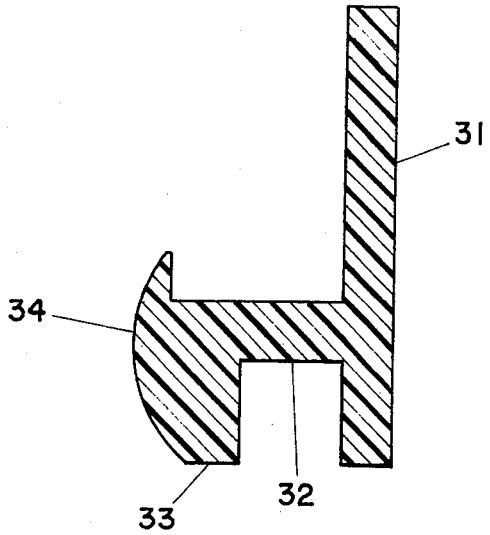
FIG. 6 is an enlarged fragmentary vertical sectional view taken through line 6—6 of FIG. 3.
Figure 7:
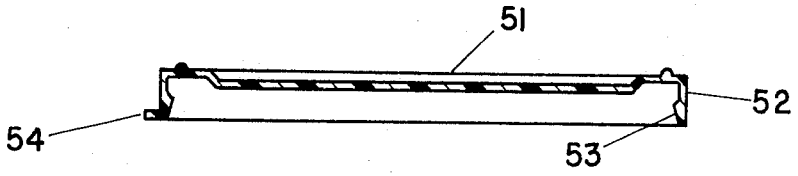
FIG. 7 is a vertical cross-sectional view of the snap-fit cover taken through line 7—7 of FIG. 1.

Referring now to the drawings in detail, FIG. 1 illustrates a safety closure device for a can or container 10 having a cylindrical mouth 15 comprising a rotatable annular collar generally referred to by numeral 30 and a snap-fit cap generally referred to by numeral 50 having a top panel portion 51 and an annular skirt 52 depending therefrom. As is best seen in FIG. 2, the can 10 is of conventional construction having a top end rim 14 defining the mouth 15 and an inwardly directed annular groove 11 formed therein extending completely around the wall of the can 10 underneath an annular bead 12 adapted to receive and hold the snap-fit cap 50. The annular bead 12 protrudes radially outwards from the body of can 10 and is formed when an easy opening can end means generally referred to by the numeral 13, such as that described in U.S. Pat. No. 3,451,586, is secured to the top end rim 14 of the can 10. While the annular bead 12 is described as being formed by the seam resulting from securing the can end means 13 to the end rim 14, the can end means 13 can be omitted and the annular bead 12 formed by other conventional means can be, if desired, positioned to encircle the mouth 15 or somewhere between the mouth 15 and the annular groove 11.

The annular collar generally referred to by the numeral 30 is made of a suitable plastic resilient material such as polypropylene and the like and has an upstanding exterior wall member 31 which prevents access to the snap-fit cover 50. This exterior wall member 31 is interrupted by a gate 36 of suitable proportion to permit entry of an adult's thumb or finger. An inwardly extending flange 32 connects the exterior wall member 31 and an interior annular rib member generally referred to by numeral 33. The annular rib member 33 has a container engaging inner wall 34 frictionally fitted to the annular groove 11. To permit relatively easy rotation of the annular collar 30 about the can 10, the inner wall 34 has a plurality of flattened portions 35. This substantially reduces the frictionable contact between the inner wall 34 and the annular groove 11 but does not prevent securely fitting the annular collar 30 by means of the inner wall 34 to the annular groove 11 in such a manner that the annular collar 30 cannot be removed forcably by children, but still can be rotated readily. Flange 32 has a raised flat area 37 extending outwardly from the inner wall 34 adjacent to and circumferentially extending at least the width of the gate 36 to reinforce the flange 32 and prevent access to the bottom peripheral edge of the annular skirt 52.

The snap-fit cap 50 is conventionally constructed of pliable material such as polypropylene and the annular skirt 52 downwardly extends from the periphery of the top panel 51. The lower portion of the skirt 52 is formed with an inwardly projecting annular bead 53 adapted to snap over the annular bead 12 of the container 10 for releasable holding engagement. Outwardly extending from the lower margin of the depending skirt 52 is a lift tab 54. When the collar 30 is rotated so that the gate 36 and the lift tab 54 are aligned, the lift tab 54 extends radially outwardly to the extent that it overlaps the flat area 35 but less than the inner surface of the upstanding exterior wall member 31.

In use, the snap-fit cover 50 is placed on the container 10 so that the lift tab 54 and gate 36 are not adjacent to each other or if they are the annular collar 30 is rotated by grasping and turning the annular upstanding wall member 31 which can be optionally knurled to aid in gripping. This rotation causes the lift tab 54 and the gate 36 to be moved out of alignment so that the tab 54 is located behind the upstanding wall member 31 of the annular collar 30 and hence is relatively inaccessible. In this position, the snap-fit cover 50 cannot be removed since the raised flat area 37 precludes access to the bottom peripheral edge of the annular skirt 52 and the depending annular skirt 52 has no other protrusions or indentations which would serve as a means to apply a removable force thereto. To remove the snap-fit cover 50, the annular collar is again rotated to bring the lift tab 54 and the gate 36 back into alignment and the snap-fit cover is then in position for lifting by insertion of a finger or thumb nail between the raised flat area 33 of the flange 32 and the bottom of the lift tab 54 which overlaps the raised flat area 33.

While specific structural details have been shown and described, it should be understood that changes and alterations may be resorted to without departing from the spirit of the invention as defined in the appended claims.

What is claimed is:

1. A rotatable safety closure annular collar in combination with a snap-fit cap and a cylindrical container having an inwardly directed annular groove extending completely around the wall of said container and an outwardly projecting annular bead formed for releasable holding engagement with said snap-fit cap, said projecting annular bead encircles the mouth or is positioned between the mouth and said annular groove of said container, said snap-fit cap having a top panel, an annular skirt depending from the periphery of said top panel, a lift tab extending outwardly from the lower margin of said depending skirt, and an annular bead projecting inwardly from said depending annular skirt adapted to snap over said outwardly projecting annular bead of said container, said annular collar comprising an upstanding exterior wall member having an access gate, an inwardly extending flange connecting said exterior wall member and an interior annular rib member having a container engaging inner wall frictionally fitted to said annular groove of said container, wherein said container engaging inner wall has a plurality of flattened portions whereby friction is reduced and said annular collar can be easily rotated relative to said container, and said flange has a raised flat area extending outwardly from said inner wall adjacent to and circumferentially extending at least the width of said gate whereby said flange is reinforced and access to the bottom peripheral edge of said depending annular skirt is prevented.

* * * * *